United States Patent [19]

Terry

[11] 4,093,242

[45] June 6, 1978

[54] SLAG BLOWER WALL BOX SEAL

[76] Inventor: Stevens M. Terry, Rte. No. 1, Box 500, Evington, Va. 24550

[21] Appl. No.: 801,613

[22] Filed: May 31, 1977

[51] Int. Cl.[2] ..... F16J 15/56; F22B 37/52

[52] U.S. Cl. ..... 277/58; 277/157; 122/392; 277/DIG. 8; 277/DIG. 4

[58] Field of Search ..... 277/58, 101, 119, 120, 277/142, 157, 167.3, 197, DIG. 4, DIG. 8; 15/406, 407; 122/383, 384, 390–392

[56] References Cited

U.S. PATENT DOCUMENTS

| | | | |
|---|---|---|---|
| 688,790 | 12/1901 | Morris et al. | 277/157 |
| 1,048,657 | 12/1912 | Christenson | 277/157 |
| 1,326,064 | 12/1919 | Keller | 277/157 X |
| 2,538,683 | 1/1951 | Guiler et al. | 277/101 X |
| 2,958,311 | 11/1960 | Singleton | 122/392 |

FOREIGN PATENT DOCUMENTS

| | | | |
|---|---|---|---|
| 189,864 | 12/1922 | United Kingdom | 122/392 |
| 207,131 | 11/1923 | United Kingdom | 122/392 |
| 388,148 | 2/1933 | United Kingdom | 122/392 |
| 525,626 | 9/1940 | United Kingdom | 277/58 |
| 762,323 | 11/1956 | United Kingdom | 122/390 |

*Primary Examiner*—Robert S. Ward, Jr.
*Attorney, Agent, or Firm*—Jerry A. Thiebeau

[57] ABSTRACT

A slag blower wall box has a first seal incorporated therein engagable with a slag blower or lance tube extending therethrough and a second seal fixed to the wall box and engagable with the slag blower and with a flange on the wall box. The second seal which is split diametrically is held together by a spring and is held against the outer flange of the wall box by a thrust ring. The second seal floats or is movable radially of the wall box so as to provide a seal with the wall box flange and at the same time to provide a seal around the periphery of the tubular slag blower.

14 Claims, 4 Drawing Figures

38
2
2
67
65
69
69
69
63
71
61
55
47
42
71
71
71
7
27
29
29
5
17
11
19
33
31
23
35
25
41
37
37
13
73
77
75
75
75
15
9
21
3
1
83
83
39
81

SLAG BLOWER WALL BOX SEAL

BACKGROUND OF THE INVENTION

This invention relates to a wall box seal for the slag blower or lance tube of a device employed for blowing soot or other combustion products from the tubes of boilers.

Customarily, a plurality of wall box seals are mounted on the side wall of a boiler with the rotatable and projectable tubular slag blower or cleaning element extending therethrough and into the combustion chamber adjacent the boiler tubes to be cleaned. The wall box seals are provided for the purpose of preventing products of combustion and soot from escaping from the interior of the boiler to the exterior thereof along the outer surface of the tubular slag blower as it rotates and reciprocates and conveys fluid under pressure to nozzles or outlet openings in the slag blower at the head end thereof.

The tubular slag blower member, through which steam, air or some other suitable cleaning material is forced under pressure for blowing the boiler tubes clean, usually becomes warped due to the heat of the furnace and roughened and worn on its outer surface where it slides and rotates through the wall box seal. The seal also becomes worn and must frequently be replaced or repaired in order to prevent the escape from the boiler interior of soot and combustion products which present health hazards to persons in the area adjacent the boiler.

SUMMARY OF THE INVENTION

The present invention is directed to an improved wall box seal which fits tightly around the tubular slag blower or lance tube and prevents soot and other combustion products from being blown out of the interior of the boiler around the slag blower member. The present seal is adapted to expand and contract so as to conform to the outer surface of the slag blower member and at the same time to slide radially in order to accomodate irregularities and warpage of the slag blower member as it rotates and reciprocates.

It is, therefore, a principal object of this invention to provide a wall box seal which may be readily installed without disturbing a seal already in place.

Another object of the invention is to provide a seal which consists of few parts and is inexpensive to manufacture.

A further object is to provide a seal which will prevent the escape of products of combustion from a furnace combustion chamber past a worn out seal already in place.

These and other objects and advantages of the invention will become more apparent from the following description of a preferred form of the invention when taken in conjunction with the drawings.

DESCRIPTION OF THE PREFERRED EMBODIMENT

Figure 1:
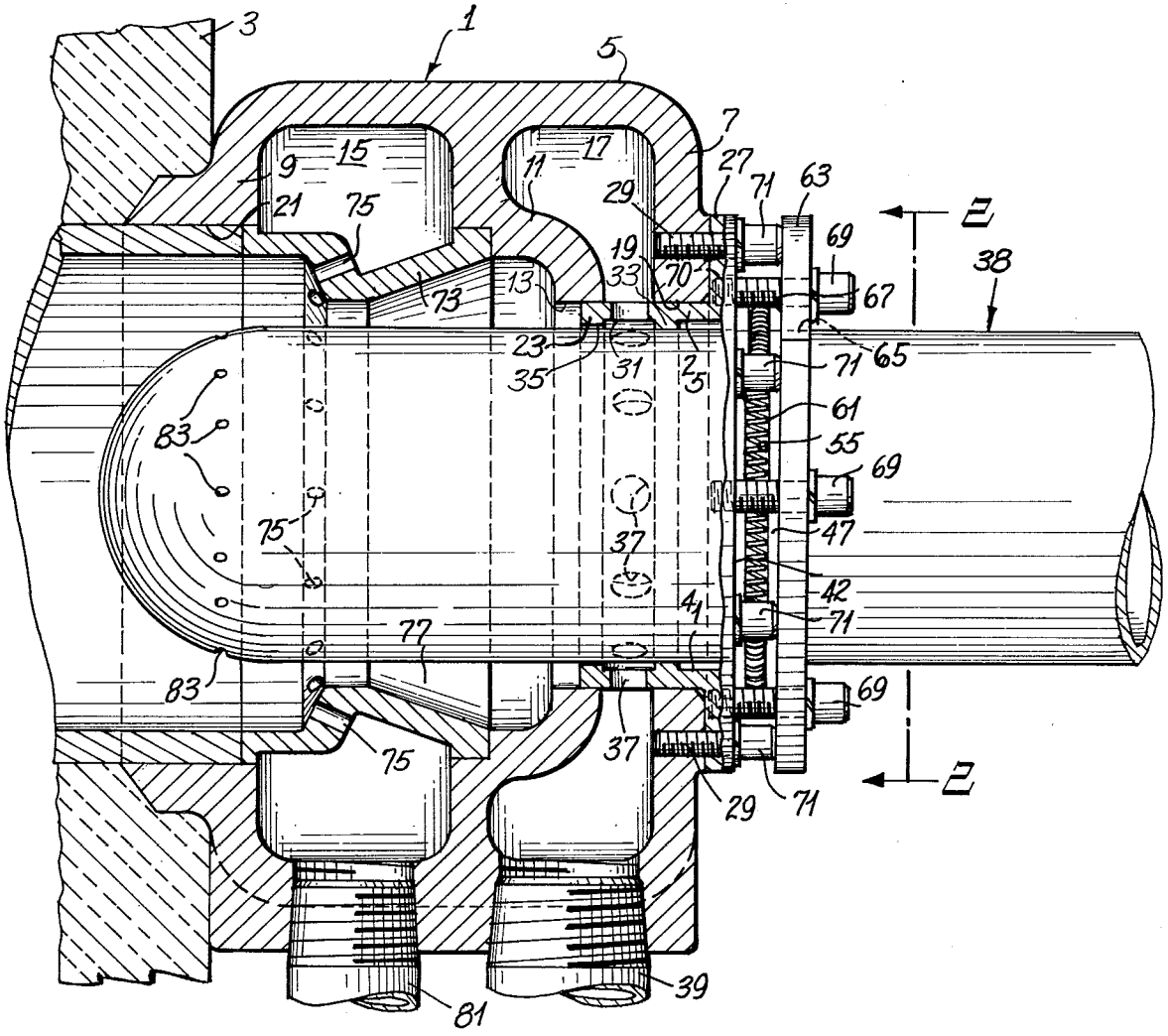
FIG. 1 is a fragmentary side elevational view, partly in section, of a wall box and seal arrangement for a tubular slag blower according to the present invention.
Figure 2:
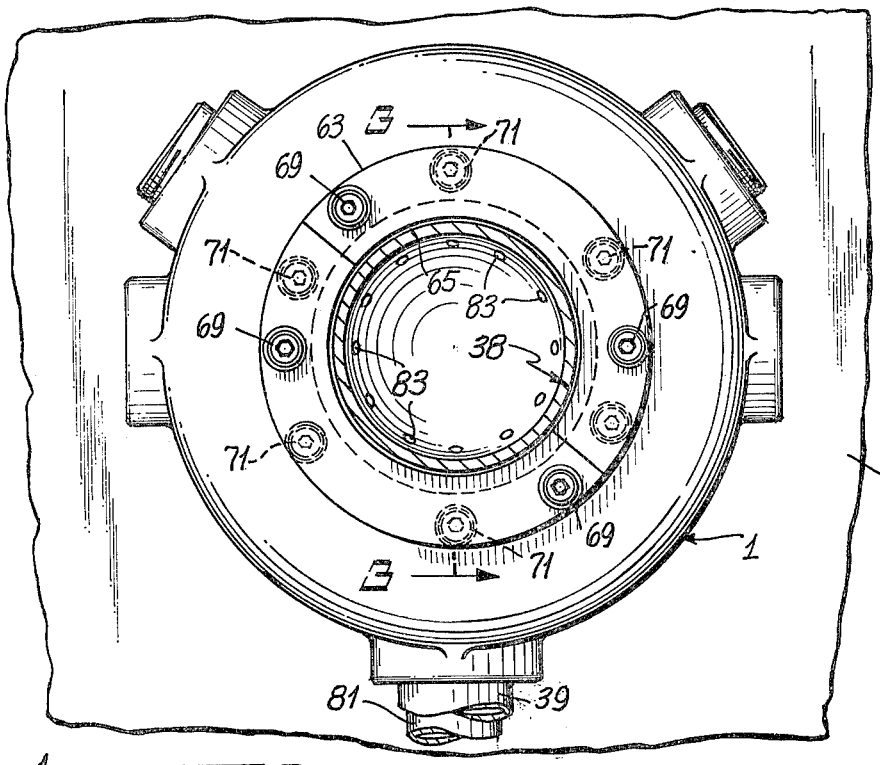
FIG. 2 is a fragmentary and elevational view, partly in section, of the wall box and slag blower tube on a smaller scale and taken on the line 2—2 of FIG. 1.
Figure 3:
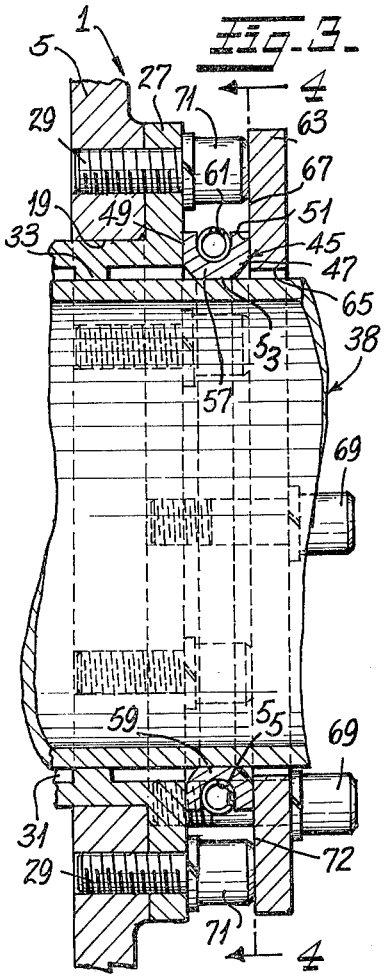
FIG. 3 is an enlarged fragmentary vertical sectional view, taken on the line 3—3 of FIG. 2.
Figure 4:
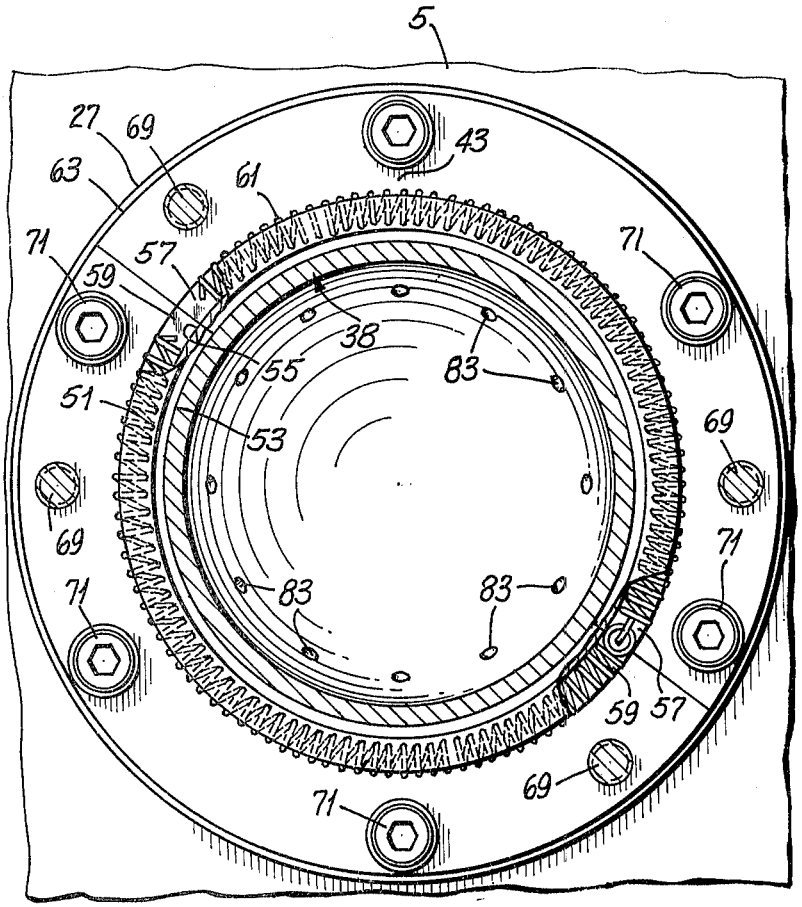
FIG. 4 is a transverse vertical sectional view, with portions of the seal broken away, taken on the line 4—4 of FIG. 3.

As shown in the drawings, a wall box generally designated by the reference numeral 1 is mounted in the side wall 3 of a boiler having a plurality of tubes, not shown, contained therein.

The wall box 1 includes a housing 5 provided with an outer wall 7 and an inner wall 9 fixedly mounted in the furnace wall 3. A partition 11 provided with a central opening 13 divides the interior of the wall box housing 5 into an inner annular chamber 15 and an outer annular chamber 17. The outer wall 7 is provided with an opening 19 of substantially the same diameter as central opening 13 while the inner wall 9 is provided with an opening 21 somewhat larger in diameter than the openings 13 and 19.

A first seal member 23 mounted in the openings 13 and 19 has an outer peripheral wall 25 which is a close sliding fit in these openings. The first seal member 23 includes an integral, radially extending flange 27 secured to the outer wall of the wall box housing 5 by a plurality of threaded fasteneres 29.

The first seal member 23 is provided with an annular recess 31 on its inner surface located between the inwardly extending annular shoulder 33 and the inwardly extending annular shoulder 35. A plurality of openings 37 extend through the wall of the first seal member 23 and open into the annular recess 31 thereby providing communication between the annular chamber 17 and the interior of the first seal member 23. The annular shoulder 35 is a littler larger in diameter than the annular shoulder 33 which initially is a close fit around the tubular slag blower or lance tube 38 and provides a seal for the slag blower as it rotates and slides therethrough. A pipe 39 threaded into the wall box housing 5 connects the annular chamber 17 to a source of fluid under pressure, not shown, such as air, steam or the like.

The outer surface 42 of the radial flange 27 is smooth and planar and the threaded fasteners 29 are arranged in a circle and are spaced radially outwardly from the central opening 41 of the flange 27 so as to provide an annular, radially extending, planar surface 43 extending for a substantial distance radially outwardly of the central opening 41.

A second seal member 45 is disposed contiguous with the radially extending, planar surface 43 of the first seal member 23. The second seal member 45 comprises a split annular ring 47 having parallel inner and outer surfaces 49 and 51 respectively. The inner diameter 53 of the annular seal ring 47 is substantially the same as or only slightly larger than the outer diameter of the slag blower or lance tube 38 adapted to be inserted therethrough.

The split annular seal ring 47 is provided on its outer surface with an annular recess 55 and is divided on its diameter into two equal parts 57 and 59. A tension type garter spring 61 is disposed in the annular recess 55 and secures the two parts of the annular ring together.

A thrust ring 63 having a central opening 65 and a planar inner surface 67 disposed normal to the axis of the central opening is carried by the outer wall 7 of the wall box housing 5 by means of threaded fasteners 69. These fasteners, which extend through openings in the thrust ring and are screwed into threaded jack screw openings 70 formed in the radial flange 27, are spaced radially outward of the central opening 65 to provide a radially extending, annular, planar surface 72 contiguous with the outer surface 51 of the second seal ring 47.

The inner planar surface 67 of the thrust ring 63 is spaced from the planar surface 43 of the radial flange 27 by the heads 71 of the threaded fasteners 29. These heads space the opposed planar surfaces of thrust ring 63 and of radial flange 27 apart by a distance which is slightly greater than the distance between the parallel faces or surfaces 49 and 51 of the annular seal ring 47 so that the seal ring may float or slide radially.

An annular member 73 disposed within the wall box housing 5 and extending from the inner wall 9 to the partition 11 forms an inner wall for the annular chamber 15. The annular member 73 is provided with a plurality of inclinded openings 75 which connect the annular chamber 15 with the interior passage 77 of the wall box seal through which the lance or slag blower 38 extends. A supply pipe 81 threaded into the wall box housing 5 is connected with a source of fluid under relatively high pressure, not shown, for supplying fluid to the annular chamber 15 for projection through the openings 75.

In operation, the tubular slag blower or lance 38 is rotated and advanced into the boiler through the seals 33 and 45 of the wall box 1 while compressed air or other suitable cleaning fluid supplied through the tubular slag blower or lance 38 to the nozzles 83 is discharged therefrom against the boiler tubes for removing soot and the like from their surfaces. At the same time compressed air is supplied to annular chamber 17 through the pipe 39 and, if desired, to the annular chamber 15 through the pipe 81.

The compressed air supplied to annular chamber 17 is furnished under greater pressure than the pressure within the boiler and continually flows between the outer surface of the slag blower 38 and the inner surface of the annular shoulder 35 of the first seal member 23 and into the interior of the boiler thereby assisting in preventing the escape of soot of other combustion material from the interior of the boiler past the seals 33 and 45 to the exterior thereof.

The inner surface 53 of the split annular ring 47 is held in sealing engagement with the exterior surface of the tubular slag blower 38 by the garter spring 61 as the slag blower rotates and advances and retracts. The second seal member 45 may also float or move radially to accomodate radial movement of the tubular slag blower 79 and a radial seal will be provided as the inner parallel surface 49 of the annular ring 47 slides against the outer planar surface 43 of the radial flange 27.

The compressed air furnished to the annular chamber 15 through the supply pipe 81 is projected toward the interior of the boiler through the openings 75. This air is under a pressure substantially greater than that present within the boiler and assists in preventing soot and other products of combustion from passing from the boiler interior outwardly toward the seals 33 and 45 of the wall box.

The floating seal 45, which provides an annular seal with the exterior surface of the tubular slag blower member as well as a radial seal with the fixed planar surface 43, in combination with the seal 33 substantially prevent the escape from the boiler of any soot or other combustion products through the wall box. If desired, resilient means such as a spring or springs, not shown, may be installed between the outer surface 51 of the seal ring 47 and the inner surface 67 of the thrust ring 63 for biasing the surface 49 of the floating seal ring against the fixed surface 43 of the flange 27.

While a typical first seal means is shown incorporated in the wall box, it would be obvious to one skilled in the art that the present second floating seal could be employed with wall boxes incorporating other types of first seal means.

What I claim is:

1. A slag blower wall box seal for an opening in a boiler wall adapted to seal around a slag blower or lance tube extending therethrough and into the interior of the boiler, comprising: a wall box having first sealing means contained therein engagable with a rotatable and axially slidable slag blower tube for substantially preventing products of combustion from escaping from the interior of the boiler to the exterior thereof between the slag blower tube and the first sealing means, said wall box including an outer annular flange provided with an opening through which the slag blower tube is to extend, said flange being fixed to the wall box and having a planar outer surface disposed normal to the opening in said first sealing means, in combination with a second seal disposed outside of said wall box and comprising: a diametrically split, floating seal ring having an opening therethrough of substantially the same diameter as the outer diameter of the slag blower tube, said floating seal ring having parallel sides and being mounted on the wall box with its inner side contiguous with and slidable on the planar outer surface of said flange, resilient means securing the parts of the split ring together so that the opening in the ring will engage with the outer surface of a slag blower tube extending therethrough, a thrust ring having a planar inner surface and an opening extending therethrough of a diameter larger than the outer diameter of the slag blower tube but smaller than the outer diameter of the floating split ring, said thrust ring being mounted on the exterior wall of the wall box with its planar inner surface contiguous with and slidably engaged by the outer parallel surface of the floating split seal ring, and with its opening in substantially axial alignment with the opening in said first sealing means, means spacing the inner planar surface of the thrust ring from the opposed outer planar surface of the annular flange, and means fixedly securing said thrust ring to the wall box, said spacing means being slightly greater than the distance between the parallel faces of the floating split seal ring by an amount only sufficient to permit the floating seal ring to move radially between said opposed planar surfaces and at the same time to sealingly engage said planar surfaces and the outer surface of a slag blower tube extending therethrough.

2. A slag blower wall box seal according to claim 1 in which said split, floating seal ring includes an annular recess around its periphery and said resilient means is an annular spring surrounding said split seal ring and disposed in said annular recess.

3. A slag blower wall box seal according to claim 2 in which said spring is a tension-type garter spring.

4. A slag blower wall box seal according to claim 1 in which the first sealing means is fixed to the wall box by threaded bolts having heads of substantially uniform height, the inner surface of said thrust ring being secured in abutment with the outer surface of the heads of said bolts.

5. A slag blower wall box seal according to claim 4 wherein a plurality of threaded fasteners are employed for securing said thrust ring to said wall box and said threaded fasteners are threaded into openings formed in the flange of said first seal means.

6. A slag blower wall box seal according to claim 1 in which the thrust ring is split diametrically.

7. A slag blower wall box seal according to claim 1 wherein said flange and said first seal means are integral.

8. A slag blower wall box seal for an opening in a boiler wall adapted to seal around a slag blower or lance tube extending therethrough and into the interior of the boiler, comprising: a wall box having first sealing means contained therein engagable with a rotatable and axially slidable slag blower tube for substantially preventing products of combustion from escaping from the interior of the boiler to the exterior thereof between the slag blower tube and the first sealing means, said wall box including an outer annular flange provided with an opening through which the slag blower tube is to extend, said flange being fixed to the box and having a planar outer surface disposed normal to the opening in said first sealing means, in combination with a second seal disposed outside of said wall box and comprising: a split, floating seal ring having an opening therethrough of substantially the same diameter as the outer diameter of the slag blower tube, said floating seal ring having a planar inner side and being mounted on the wall box with its inner side contiguous with and slidable on the planar outer surface of said flange, resilient means securing the parts of the split ring together so that the opening in the ring will engage with the outer surface of a slag blower tube extending therethrough, and means carried by said wall box engaging the outer side of said floating seal ring for holding the inner side of said floating seal ring in sliding sealing engagement with the planar outer surface of said annular flange.

9. A slag blower wall box seal according to claim 8 in which said split, floating seal ring includes an annular recess around its periphery and said resilient means is an annular spring surrounding said split seal ring and disposed in said annular recess.

10. A slag blower wall box seal according to claim 9 in which said spring is a tension-type garter spring.

11. A slag blower wall box seal according to claim 10 in which said floating seal ring has an outer side parallel with said inner side and said means comprises a thrust ring fixedly secured to said wall box and having a planar inner surface in sliding engagement with the outer side of said floating seal ring.

12. A slag blower wall box seal according to claim 8 in which said floating seal ring has an outer side parallel with said inner side thereof, and said means comprises a thrust ring having a planar inner surface in sliding engagement with the outer side of said floating seal ring; and a plurality of bolts are threaded into the outer wall of said wall box concentric with the opening in said outer annular flange and spaced outwardly therefrom, said bolts having heads of substantially uniform height, the inner surface of said thrust ring being secured in abutment with the outer surface of the heads of said bolts.

13. A slag blower wall box seal according to claim 12 in which said outer annular flange is rigid with said first seal means and is secured to said wall box by said bolts.

14. A slag blower wall box seal according to claim 13 wherein a plurality of threaded fasteners secure said thrust ring to threaded openings provided in said outer annular flange.

* * * * *